US011515632B2

(12) United States Patent
Chang et al.

(10) Patent No.: US 11,515,632 B2
(45) Date of Patent: Nov. 29, 2022

(54) DUAL-BAND ANTENNA AND ANTENNA MODULE USING THE SAME

(71) Applicants: Inventec Appliances (Pudong) Corporation, Shanghai (CN); INVENTEC APPLIANCES CORP., New Taipei (TW); Inventec Appliances (Shanghai) Co. Ltd., Shanghai (CN)

(72) Inventors: Yu-Wei Chang, New Taipei (TW); Shu-Yang Tu, New Taipei (TW)

(73) Assignees: INVENTEC APPLIANCES (PUDONG) CORPORATION, Shanghai (CN); INVENTEC APPLIANCES CORP., New Taipei (TW); INVENTEC APPLIANCES (SHANGHAI) CO. LTD., Shanghai (CN)

( * ) Notice: Subject to any disclaimer, the term of this patent is extended or adjusted under 35 U.S.C. 154(b) by 16 days.

(21) Appl. No.: 17/038,136

(22) Filed: Sep. 30, 2020

(65) Prior Publication Data

US 2021/0336338 A1 Oct. 28, 2021

(30) Foreign Application Priority Data

Apr. 22, 2020 (CN) ..... 202010321309.6

(51) Int. Cl.
*H01Q 1/48* (2006.01)
*H01Q 13/10* (2006.01)
(Continued)

(52) U.S. Cl.
CPC ..... *H01Q 5/35* (2015.01); *H01Q 1/48* (2013.01); *H01Q 1/521* (2013.01); *H01Q 13/106* (2013.01)

(58) Field of Classification Search
CPC .. H01Q 1/52; H01Q 1/38; H01Q 5/48; H01Q 1/243; H01Q 9/285; H01Q 5/371;
(Continued)

(56) References Cited

U.S. PATENT DOCUMENTS 9,013,358 B2 4/2015 Hsu et al.
9,263,798 B1 * 2/2016 Piazza ..... H01Q 21/29
(Continued)

FOREIGN PATENT DOCUMENTS

CN 104505590 B 5/2018
CN 109861000 A 6/2019
(Continued)

OTHER PUBLICATIONS

TW Office Action dated Feb. 23, 2021 in Taiwan application (No. 109118283).

*Primary Examiner* — Ricardo I Magallanes
(74) *Attorney, Agent, or Firm* — McClure, Qualey & Rodack, LLP

(57) ABSTRACT

A dual-band antenna includes a first conductive portion, a ground layer, a ground portion, a second conductive portion and a third conductive portion. The first conductive portion has a resonant cavity. The ground portion extends from the ground layer toward the first conductive portion. The second conductive portion extends from the ground layer toward the first conductive portion. The third conductive portion extends from the ground layer toward the first conductive portion. The second conductive portion and the third conductive portion are disposed symmetrically with respect to the ground portion.

16 Claims, 5 Drawing Sheets

(51) Int. Cl.
*H01Q 5/35* (2015.01)
*H01Q 1/52* (2006.01)

(58) Field of Classification Search
CPC .. H01Q 1/521–525; H01Q 3/24; H01Q 3/247; H01Q 5/35; H01Q 9/42; H01Q 1/50
See application file for complete search history.

(56) References Cited

U.S. PATENT DOCUMENTS

| | | | | |
|---|---|---|---|---|
| 9,601,826 | B2 | 3/2017 | Ai et al. | |
| 2002/0024466 | A1* | 2/2002 | Masuda | H01Q 1/243 343/700 MS |
| 2008/0258992 | A1* | 10/2008 | Tsai | H01Q 1/2266 343/853 |
| 2010/0053022 | A1* | 3/2010 | Mak | H01Q 1/2283 343/893 |
| 2013/0314293 | A1 | 11/2013 | Wong et al. | |
| 2018/0006369 | A1* | 1/2018 | Higaki | H01Q 1/50 |
| 2019/0372215 | A1* | 12/2019 | Lee | H01Q 5/378 |

FOREIGN PATENT DOCUMENTS

| | | | |
|---|---|---|---|
| CN | 104300211 | B | 8/2019 |
| JP | 2012175317 | A | 9/2012 |
| TW | 201349664 | A | 12/2013 |
| TW | 201417393 | A | 5/2014 |
| TW | 201611408 | A | 3/2016 |

* cited by examiner

DUAL-BAND ANTENNA AND ANTENNA MODULE USING THE SAME

This application claims the benefit of People's Republic of China application Serial No. 202010321309.6, filed on Apr. 22, 2020, the subject matter of which is incorporated herein by reference.

FIELD OF THE INVENTION

The invention relates to an antenna and an antenna module using the same, and more particularly to a dual-band antenna and an antenna module using the same.

BACKGROUND OF THE INVENTION

A dual-frequency antenna could provide two resonance modes, so that the dual-frequency antenna could operate in two different resonance frequency bands. However, the two resonance modes will inevitably interfere with each other, and the design will increase the isolation between the two resonance modes as much as possible to reduce the degree of interference between the two resonance modes. Therefore, how to propose a technique that could improve the isolation of a dual-band antenna is one of the goals of the industry's efforts.

SUMMARY OF THE INVENTION

The present invention is to provide a dual-band antenna capable of improving the problems of the prior art.

In one embodiment of the invention, a dual-band antenna includes a first conductive portion, a ground layer, a ground portion, a second conductive portion and a third conductive portion. The first conductive portion has a resonant cavity. The ground portion extends from the ground layer toward the first conductive portion. The second conductive portion extends from the ground layer toward the first conductive portion. The third conductive portion extends from the ground layer toward the first conductive portion. The second conductive portion and the third conductive portion are arranged symmetrically with respect to the ground part.

In another embodiment of the invention, an antenna module includes a substrate and a dual-band antenna. The dual-band antenna is disposed on the substrate and includes a first conductive portion, a ground layer, a ground portion, a second conductive portion and a third conductive portion. The first conductive portion has a resonant cavity. The ground portion extends from the ground layer toward the first conductive portion. The second conductive portion extends from the ground layer toward the first conductive portion. The third conductive portion extends from the ground layer toward the first conductive portion. The second conductive portion and the third conductive portion are arranged symmetrically with respect to the ground part.

Numerous objects, features and advantages of the invention will be readily apparent upon a reading of the following detailed description of embodiments of the invention when taken in conjunction with the accompanying drawings. However, the drawings employed herein are for the purpose of descriptions and should not be regarded as limiting.

BRIEF DESCRIPTION OF THE DRAWINGS

The above objects and advantages of the invention will become more readily apparent to those ordinarily skilled in the art after reviewing the following detailed description and accompanying drawings, in which.

DETAILED DESCRIPTION OF PREFERRED EMBODIMENTS

Figure 1:
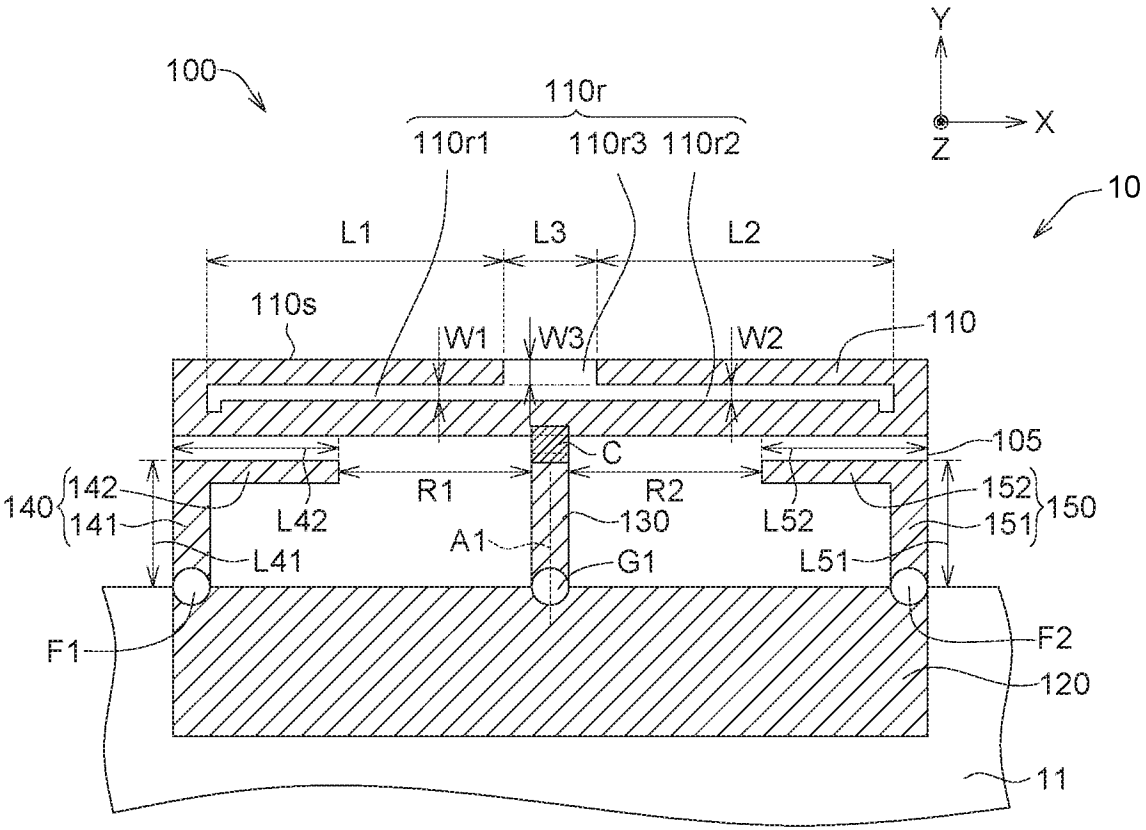
FIG. 1 is a top view of a dual-band antenna according to an embodiment of the present invention.
Figure 2:
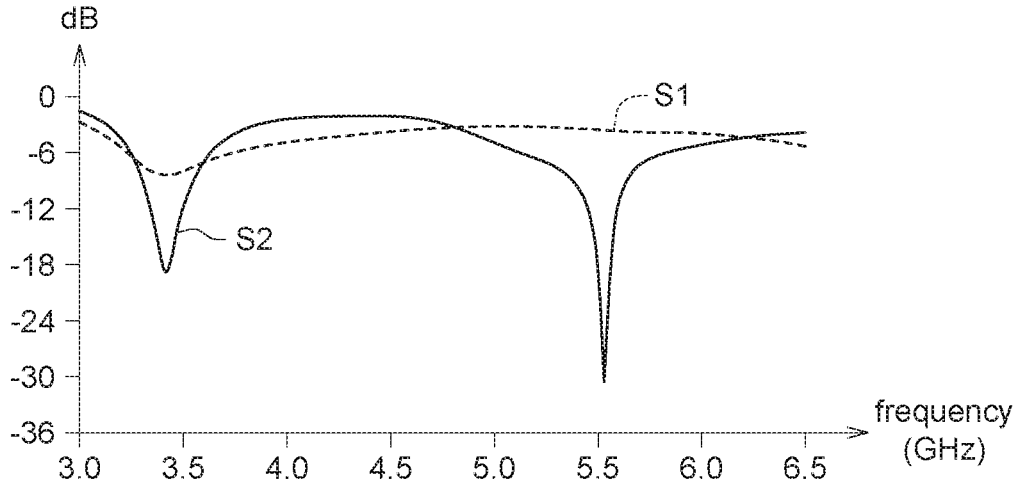
FIG. 2 is a diagram view of characteristic curve of S-parameter of the dual-band antenna 100 of FIG. 1.

Referring to FIGS. 1 and 2, FIG. 1 is a top view of a dual-band antenna 100 according to an embodiment of the present invention, and FIG. 2 is a diagram view of characteristic curve of S-parameter of the dual-band antenna 100 of FIG. 1, An antenna module 10 includes a dual-band antenna 100 and a substrate 11, wherein the dual-band antenna 100 could be partially disposed on the substrate 11. The substrate 11 is made of, for example, plastic, ceramic, glass, metal, etc. The antenna module 10 is, for example, a circuit board of an electronic device, wherein the electronic device is, for example, a notebook computer, a mobile communication device, a home appliance or other various devices that require a wireless transmission function. Furthermore, the antenna module 10 is, for example, PCB (Printed Circuit Board), FPC (Flexible Print Circuit), LDS (Laser Direct Structuring) antenna, etc.

The dual-band antenna 100 includes a substrate 105, a first conductive portion 110, a ground layer 120, a ground portion 130, a second conductive portion 140 and a third conductive portion 150. The first conductive portion 110, the ground layer 120, the ground portion 130, the second conductive portion 140 and the third conductive portion 150 are formed on the substrate 105. The ground layer 120 is electrically connected to a ground potential of the antenna module 10. In the present embodiment, the first conductive portion 110, the ground layer 120, the ground portion 130, the second conductive portion 140 and the third conductive portion 150 are, for example, the same layer structure or coplanar structure.

The first conductive portion 110 has a resonance cavity 110*r*. The ground portion 130 extends from the ground layer 120 toward the first conductive portion 110. The second conductive portion 140 extends from the ground layer 120 toward the first conductive portion 110, and the third conductive portion 150 extends from the ground layer 120 toward the first conductive portion 110. The second conductive portion 140 and the third conductive portion 150 are arranged symmetrically with respect to the ground portion 130. The resonance cavity 110*r* could change a resonance current path, so that the dual-frequency antenna 100 could provide two resonance modes (communication frequency bands).

In an embodiment, the whole of the first conductive portion 110, the ground layer 120, the ground portion 130, the second conductive portion 140 and the third conductive portion 150 are symmetrical with respect to a central axis A1 of the ground portion 130, wherein the central axis A1 is, for example, parallel to the third direction (e.g., +Y direction). In the present embodiment, the structures (the whole of the first conductive portion 110, the ground layer 120, the ground portion 130, the second conductive portion 140 and the third conductive portion 150) of the ground portion 130 on the two opposite sides of the central axis A1 form a first antenna structure and a second antenna structure respectively. The first antenna structure and the second antenna structure share the ground portion 130. In another embodiment, the whole of the first conductive portion 110, the ground layer 120, the ground portion 130, the second conductive portion 140 and the third conductive portion 150 could be asymmetric with respect to the central axis A1 of the ground portion 130.

As shown in FIG. 2, the horizontal axis represents frequency and the vertical axis represents S parameter. The curve S1 shows the relationship between the frequency and the return loss of the conventional antenna without the resonance cavity, and the curve S2 shows the relationship between the frequency and the return loss of the dual-band antenna 100 in FIG. 1, Compared with the conventional antenna (curve S1), the dual-band antenna 100 (curve S2) could provide a high-frequency band, for example, a communication band between 5.15 GHz and 5.85 GHz, and the low-frequency band provided by the dual-band antenna 100 provides smaller return loss, for example, a communication band between 3.3 GHz and 3.8 GHz. The high-frequency band of the dual-band antenna 100 conforms to the specifications of the 5th generation mobile communication technology (5G), for example.

As shown in FIG. 1, the structure of the first conductive portion 110 is symmetrical with respect to an extending direction of the ground portion 130, wherein the extending direction of the ground portion 130 is, for example, a third direction, such as +Y direction. The first conductive portion 110 has a lateral surface 110*s*. The resonance cavity 110*r* includes a first extension slot 110*r*1, a second extension slot 110*r*2 and a third extension slot 110*r*3. The first extension slot 110*r*1 extends along the first direction, and the second extension slot 110*r*2 extends along the second direction, wherein the first direction is substantially parallel to the second direction. In the present embodiment, the first direction is, for example, the −X direction, and the second direction is, for example, the +X direction. In the present embodiment, the first extension slot 110*r*1 and the second extension slot 110*r*2 are substantially collinear. However, in another embodiment, the first extension slot 110*r*1 and the second extension slot 110*r*2 could be staggered along a third direction (e.g., +Y direction). In addition, in the present embodiment, the width W1 of the first extension slot 110*r*1 and the width W2 of the second extension slot 110*r*2 are substantially equal, and the length L1 of the first extension slot 110*r*1 and the length L2 of the second extension slot 110*r*2 are substantially equal. In terms of size, in an embodiment, the widths W1 and W2 range between, for example, 2 millimeters (mm) to 5 mm, for example, 4 mm, and the lengths L1 and L2 range between, for example, 5 mm to 8 mm, for example, 7 mm.

As shown in FIG. 1, the third extension slot 110*r*3 extends to the lateral surface 110*s* from the first extension slot 110*r*1 and the second extension slot 110*r*2 along the third direction, where the third direction is, for example, the +Y direction. The second extension slot 110*r*2 has a width W3 and a length L3. In terms of size, in an embodiment, the width W3 ranges, for example, between 0.3 mm and 1 mm, and the length L3 ranges, for example, between 1 mm and 4 mm.

As shown in FIG. 1, the ground portion 130 extends from the ground layer 120 in the third direction (e.g., +Y direction) toward the first conductive portion 110, but does not contact the first conductive portion 110. The dual-band antenna 100 further includes a capacitor element C. The ground portion 130 is connected with the first conductive portion 110 by the capacitor element C, and electrically connects the ground portion 130 with the first conductive portion 110. The capacitor element C and the ground portion 130 form a RF (Radio frequency) filter. The RF filter could blocks the current of the first antenna structure to flow toward the second antenna structure or block the current of to the second antenna structure to flow toward the first antenna structure, which could adjust and improve the isolation of the dual frequency antenna at low frequency. The capacitance of the capacitor element C is, for example, between 0.6 pF and 1.0 pF, for example, 0.8 pF.

The structures of the second conductive portion 140 and the third conductive portion 150 are symmetrical with respect to the extending direction of the ground portion 130. In the present embodiment, as shown in FIG. 1, the second conductive portion 140 includes a first extension portion 141 and a second extension portion 142 connected to each other. The first extension portion 141 is substantially parallel to the ground portion 130, and the second extension portion 142 extends from the first extension portion 141 toward the ground portion 130. For example, the first extension portion 141 extends from the ground layer 120 in the third direction (e.g., +Y direction) toward the first conductive portion 110, and the second extension portion 142 extends from the first extension portion 141 in the second direction (e.g., +X direction) toward the ground portion 130, but does not contact the ground portion 130. In the present embodiment, the interval R1 between the second extension portion 142 and the ground portion 130 ranges, for example, between 8.5 mm and 10.5 mm, for example, 8.5 mm. In terms of size, the first extension 141 has a length L41, and the second extension 142 has a length L42, where the length L41 is, for example, between 2 mm and 4 mm, for example, 3 mm, and the length L42 is, for example, between 8 mm and 10 mm, for example, 9 mm.

As shown in FIG. 1, the third conductive portion 150 includes a third extension portion 151 and a fourth extension portion 152 connected to each other. The third extension portion 151 is substantially parallel to the ground portion 130, and the fourth extension portion 152 extends from the third extension portion 151 toward the ground portion 130. For example, the third extension portion 151 extends from the ground layer 120 in the third direction (e.g., +Y direction) toward the first conductive portion 110, and the fourth extension portion 152 extends from the third extension portion 151 in the first direction (e.g., −X direction) toward the ground portion 130, but does not contact the ground portion 130. In the present embodiment, the interval R2 between the fourth extension portion 152 and the ground portion 130 ranges, for example, between 8.5 mm and 10.5 mm, for example, 8.5 mm. In terms of size, the third extension 151 has a length L51, and the fourth extension 152 has a length L52, wherein the length L51 ranges, for example, between 2 mm and 4 mm, for example, 3 mm, and the length L52 ranges, for example, 8 mm and 10 mm, for example, 9 mm.

As shown in FIG. 1, the dual-band antenna 200 further includes a first feeding point F1, a second feeding point F2 and a ground point G1. The first feeding point F1 is located at the second conductive portion 140. For example, the first feeding point F1 is located between the first extension portion 141 of the second conductive portion 140 and the ground layer 120. The second feeding point F2 is located in the third conductive portion 150. For example, the second feeding point F2 is located between the third extension portion 151 of the third conductive portion 150 and the ground layer 120. The ground point G1 is located at the ground portion 130. For example, the ground point G1 is located between the ground portion 130 and the ground layer 120.

Figure 3:
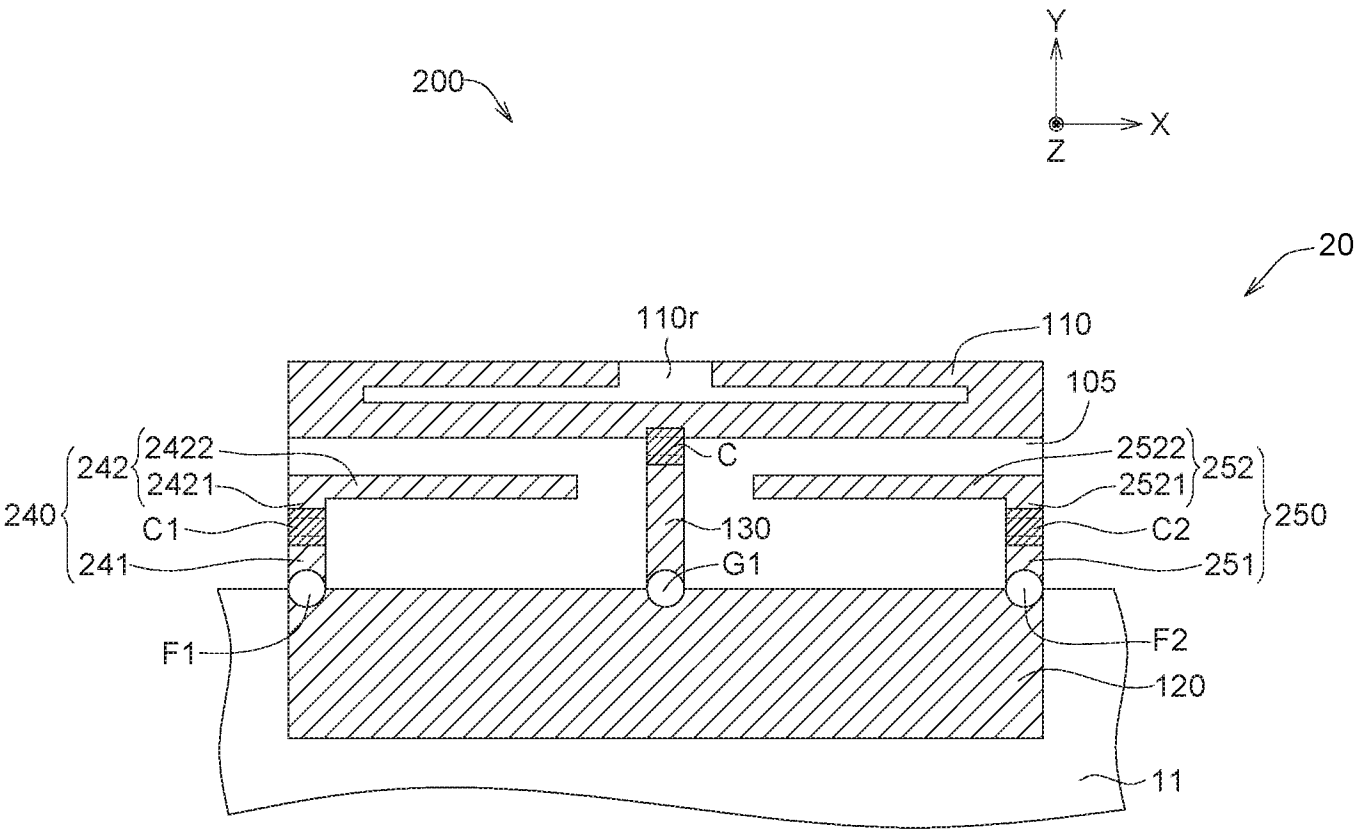
FIG. 3 is a top view of a dual-band antenna according to another embodiment of the present invention.
Figure 4:
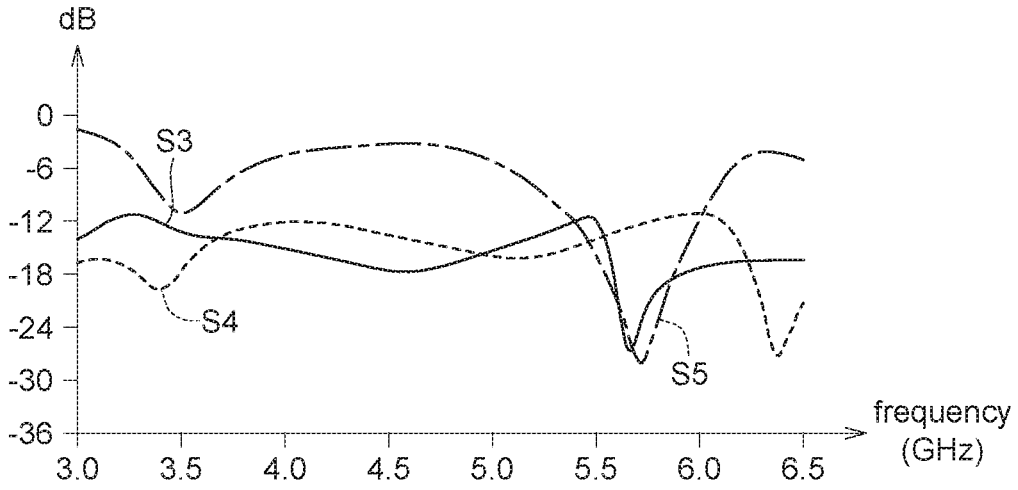
FIG. 4 is a diagram view of characteristic curve of S-parameter of the dual-band antenna of FIG. 3.

Referring to FIGS. 3 and 4, FIG. 3 is a top view of a dual-band antenna 200 according to another embodiment of the present invention, and FIG. 4 is a diagram view of the characteristic curve of the S-parameter of the dual-band antenna 200 of FIG. 3. An antenna module 20 includes a dual-band antenna 200 and the substrate 11, wherein the dual-band antenna 200 could be partially disposed on the substrate 11 of the antenna module 20. The antenna module 20 is, for example, embodied in a circuit board of an electronic device. The electronic device is, for example, a notebook computer, a mobile communication device, a home appliance or other devices that require a wireless transmission function. The dual-band antenna 200 includes the substrate 105, the first conductive portion 110, the ground layer 120, the ground portion 130, a second conductive portion 240, a third conductive portion 250, the first capacitor element C1 and a second capacitor element C2. The first conductive portion 110, the ground layer 120, the ground portion 130, the second conductive portion 240, and the third conductive portion 250 are formed on the substrate 105. The ground layer 120 is electrically connected to the ground potential of the antenna module 20. Furthermore, the antenna module 20 is, for example, PCB, FPC, LDS antenna, etc.

The dual-band antenna 200 has the same or similar structure as the dual-band antenna 100, except that the structure of the second conductive portion 240 of the dual-band antenna 200 is different from the structure of the second conductive portion 140, and the structure of the third conductive portion 250 also is different from the third conductive portion 150.

For example, as shown in FIG. 3, the second conductive portion 240 includes a first extension portion 241 and a second extension portion 242 isolated from each other, the first extension portion 241 and the ground portion 130 are substantially parallel, the second extension portion 242 extends toward the ground portion 130. For example, the first extension portion 241 extends from the ground layer 120 in the third direction (e.g., +Y direction) toward the first conductive portion 110, and the second extension portion 242 extends from the first extension portion 241 in the second direction (e.g., +X direction) toward the ground portion 130, but does not contact the ground portion 130. The second extension portion 242 includes a first sub-extension portion 2421 and a second sub-extension portion 2422, wherein the first sub-extension portion 2421 is substantially parallel to the ground portion 130, and the second sub-extension portion 2422 extends from the first sub-extension portion 2421 extends toward the ground portion 130. For example, the first sub-extension portion 2421 extends in the third direction (e.g., +Y direction) toward the first conductive portion 110, and the second sub-extension portion 2422 extends from the first sub-extension portion 2421 in the second direction (e.g., +X direction) extends toward the ground portion 130, but does not contact the ground portion 130.

As shown in FIG. 3, the third conductive portion 250 includes a third extension portion 251 and a fourth extension portion 252 isolated from each other. The third extension portion 251 is substantially parallel to the ground portion 130, and the fourth extension portion 252 extends toward the ground portion 130. For example, the third extension portion 251 extends from the ground layer 120 in the third direction (e.g., +Y direction) toward the first conductive portion 110, and the fourth extension portion 252 extends from the third extension portion 251 in the first direction (e.g., −X direction) toward the ground portion 130, but does not contact the ground portion 130. The fourth extension portion 252 includes a third sub-extension portion 2521 and a fourth sub-extension portion 2522 connected to the third sub-extension portion 2521, wherein the third sub-extension portion 2521 is substantially parallel to the ground portion 130, and the fourth sub-extension portion 2522 extends from the third sub-extension portion 2521 toward the ground portion 130. For example, the third sub-extension portion 2521 extends in the third direction (e.g., +Y direction) toward the first conductive portion 110, and the fourth sub-extension portion 2522 extends from the third sub-extension portion 2521 in the first direction (e.g., −X direction) extends toward the ground portion 130, but does not contact the ground portion 130.

As shown in FIG. 3, the first extension portion 241 is connected with the second extension portion 242 by the first capacitor element C1, and electrically connects the first extension portion 241 with the second extension portion 242, and the third extension portion 251 is connected with the fourth extension portion 252 by the second capacitor element C2, wherein the second capacitor element C2 electrically connects the third extension portion 251 with the fourth extension portion 252. The first capacitor element C1 and the second capacitor element C2 could adjust the impedance of the imaginary part in the impedance formula of the dual-band antenna 200, and could improve the isolation of the dual-band antenna 200 in the low-frequency band. In an embodiment, the capacitance of the first capacitor element C1 and the capacitance of the second capacitor element C2 range, for example, between 0.5 F and 0.7 pF, for example, 0.6 pF.

As shown in FIG. 4, the horizontal axis represents frequency, and the vertical axis represents S parameter. Curve S3 shows the relationship between the frequency and the isolation of the dual-band antenna 100 of FIG. 1, and curve S4 shows the relationship between the frequency and the isolation of the dual-band antenna 200 of FIG. 3. Compared with the dual-band antenna 100 (curve S3), the dual-band antenna 200 (curve S4) has better isolation in the low-frequency band (the better the isolation is, the less the signal interfere between the second conductive portion 140 (or the first antenna structure) and the third conductive portion 150 (or the second antenna structure) is). In an embodiment, the isolation of the dual-band antenna 200 (curve S4) in the low-frequency band ranges approximately between −11 dB and −16 dB.

Figure 5:
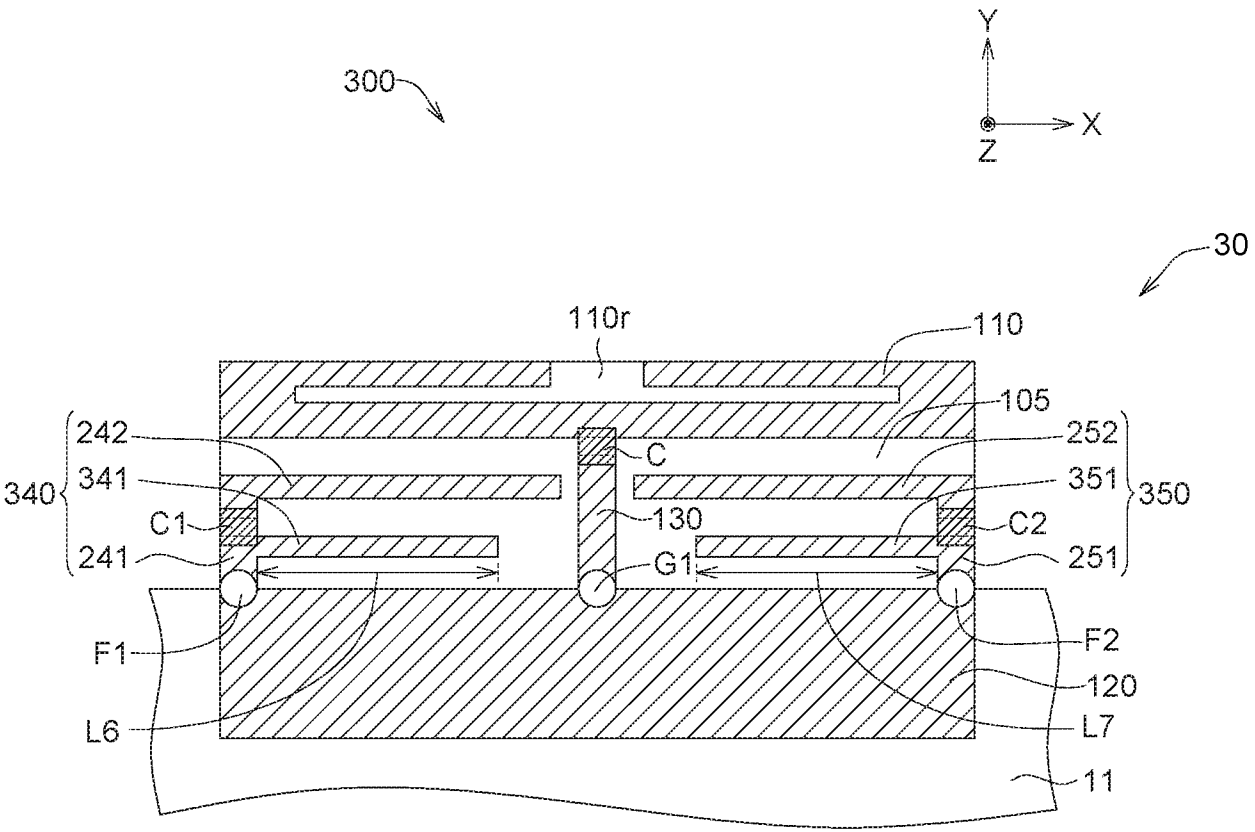
FIG. 5 is a top view of a dual-band antenna according to another embodiment of the present invention.

FIG. 5 is a top view of a dual-band antenna 300 according to another embodiment of the present invention. An antenna module 30 includes a dual-band antenna 300 and the substrate 11, wherein the dual-band antenna 300 could be partially disposed on the substrate 11 of the antenna module 30. The antenna module 30 is, for example, a circuit board of an electronic device, wherein the electronic device is, for example, a notebook computer, a mobile communication device, a home appliance or other devices that require a wireless transmission function. The dual-band antenna 300 includes the substrate 105, the first conductive portion 110, the ground layer 120, the ground portion 130, a second conductive portion 340, a third conductive portion 350, the first capacitor element C1 and the second capacitor element C2. The first conductive portion 110, the ground layer 120, the ground portion 130, the second conductive portion 340, and the third conductive portion 350 are formed on the substrate 105. The ground layer 120 is electrically connected to the ground potential of the antenna module 30. Furthermore, the antenna module 30 is, for example, PCB, FPC, LDS antenna, etc.

The dual-band antenna 300 has the same or similar structure as the dual-band antenna 200, except that the structure of the second conductive portion 340 of the dual-band antenna 300 is different from that of the second conductive portion 240, and the structure of the third conductive portion 350 also is different from the third conductive portion 250.

For example, as shown in FIG. 5, the second conductive portion 340 includes a fifth extension portion 341 and the first extension portion 241 and the second extension portion 242 isolated from each other, wherein the fifth extension portion 341 is connected to the first extension portion 241. For example, the fifth extension portion 341 extends from the first extension portion 241 in the second direction (e.g., +X direction) toward the ground portion 130. The fifth extension 341 has a length L6. The length L6 ranges, for example, between 6 mm and 8 mm, for example, 7 mm. The third conductive portion 350 includes a sixth extension portion 351 and the third extension portion 251 and the fourth extension portion 252 isolated from each other, wherein the sixth extension portion 351 is connected to the third extension portion 251. For example, the sixth extension portion 351 extends from the third extension portion 251 in the first direction (e.g., −X direction) toward the ground portion 130. The sixth extension 351 has a length L7. The length L7 ranges, for example, between 6 mm and 8 mm, for example, 7 mm.

The fifth extension portion 341 and the sixth extension portion 351 could adjust the real part impedance of the impedance formula of the dual-band antenna 300, and could increase the bandwidth of the dual-band antenna 300 in a high-frequency band. As shown in FIG. 4, the curve S5 represents the relationship between the frequency and the return loss of the dual-band antenna 300 of FIG. 5. Compared to the dual-band antenna 100 (curve S2 in FIG. 2), the dual-band antenna 300 (curve S5) has a wider bandwidth in the high-frequency band.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A dual-band antenna, comprises:

a first conductive portion having a resonant cavity;

a ground layer;

a ground portion extending from the ground layer toward the first conductive portion, wherein the ground portion is spaced from the first conductive portion;

a second conductive portion extending from the ground layer toward the first conductive portion;

a third conductive portion extending from the ground layer toward the first conductive portion; and a capacitor element bridging the first conductive portion with the ground portion and electrically connecting the first conductive portion with the ground portion;

wherein the second conductive portion and the third conductive portion are arranged symmetrically with respect to the ground portion;

wherein the second conductive portion comprises a first extension portion and a second extension portion, the first extension portion is parallel to the ground portion, the second extension portion extends toward the ground portion and comprises a first free end facing the ground portion, and the first free end is separated from the ground portion by a first interval in a first facing direction of the first end;

wherein the third conductive portion comprises a third extension portion and a fourth extension portion, the third extension portion is parallel to the ground portion, and the fourth extension portion extends toward the ground portion and comprises a second free end facing the ground portion and the second free end is separated from the ground portion by a second interval in a second facing direction of the second end;

wherein the second extension portion is connected to the first extension portion and the fourth extension portion is connected to the third extension portion;

wherein the second extension portion comprises a first sub-extension portion and a second sub-extension portion connected to the first sub-extension portion, the first sub-extension portion is parallel to the ground portion, the second sub-extension portion extends from the first sub-extension portion toward the ground portion, the fourth extension portion comprises a third sub-extension portion and a fourth sub-extension portion connected to the third sub-extension portion, the third sub-extension portion is parallel to the ground portion, and the fourth sub-extension portion extends from the third sub-extension portion toward the ground portion.

2. The dual-band antenna as claimed in claim 1, wherein the first conductive portion has a lateral surface, the resonant cavity comprises a first extension slot and a second extension slot, the first extension slot extends along a first direction, and the second extension slot extends along a second direction, wherein the first direction and the second direction run along the same axis in direction opposite to one another.

3. The dual-band antenna as claimed in claim 1, wherein first extension slot and the second extension slot are substantially collinear.

4. The dual-band antenna as claimed in claim 2, wherein the resonant cavity further comprises a third extension slot extending from the first extension slot and the second extension slot along a third direction to the lateral surface, and the first direction is perpendicular to the third direction.

5. The dual-band antenna as claimed in claim 1, wherein the structure of the first conductive portion is a symmetric structure with respect to the ground portion.

6. The dual-band antenna as claimed in claim 1, wherein the first extension portion and the second extension portion are spaced from each other, and third extension portion and the fourth extension portion are spaced from each other.

7. The dual-band antenna as claimed in claim 6, wherein the dual-band antenna further comprises a first capacitor element and a second capacitor element, the first extension is connected with the second extension portion by the first capacitor element, and the third extension is connected with the fourth extension by the second capacitor element.

8. The dual-band antenna as claimed in claim 6, wherein the second conductive portion further comprises a fifth extension portion, the fifth extension portion extends from the first extension portion toward the ground portion, the third conductive portion further comprises a sixth extension, and the fifth extension portion extends from the third extension portion toward the ground portion.

9. An antenna module, comprises:

a substrate; and a dual-band antenna disposed on the substrate and comprising:

a first conductive portion having a resonant cavity;

a ground layer;

a ground portion extending from the ground layer toward the first conductive portion;

a second conductive portion extending from the ground layer toward the first conductive portion; and a third conductive portion extending from the ground layer toward the first conductive portion;

wherein the second conductive portion and the third conductive portion are arranged symmetrically with respect to the ground portion;

wherein the second conductive portion comprises a first extension portion and a second extension portion, the first extension portion is parallel to the ground portion, the second extension portion extends toward the ground portion and comprises a first free end facing the ground portion, and the first free end is separated from the ground portion by a first interval in a first facing direction of the first end;

wherein the third conductive portion comprises a third extension portion and a fourth extension portion, the third extension portion is parallel to the ground portion, and the fourth extension portion extends toward the ground portion and comprises a second free end facing the ground portion and the second free end is separated from the ground portion by a second interval in a second facing direction of the second end;

wherein the second extension portion is connected to the first extension portion, and the fourth extension portion is connected to the third extension portion;

wherein the second extension portion comprises a first sub-extension portion and a second sub-extension portion connected to the first sub-extension portion, the first sub-extension portion is parallel to the ground portion, the second sub-extension portion extends from the first sub-extension portion toward the ground portion, the fourth extension portion comprises a third sub-extension portion and a fourth sub-extension portion connected to the third sub-extension portion, the third sub-extension portion is parallel to the ground portion, and the fourth sub-extension portion extends from the third sub-extension portion toward the ground portion.

10. The antenna module as claimed in claim 9, wherein the first conductive portion has a lateral surface, the resonant cavity comprises a first extension slot and a second extension slot, the first extension slot extends along a first direction, and the second extension slot extends along a second direction, wherein the first direction and the second direction run along the same axis in direction opposite to one another.

11. The antenna module as claimed in claim 9, wherein first extension slot and the second extension slot are substantially collinear.

12. The antenna module as claimed in claim 10, wherein the resonant cavity further comprises a third extension slot extending from the first extension slot and the second extension slot along a third direction to the lateral surface, and the first direction is perpendicular to the third direction.

13. The antenna module as claimed in claim 9, wherein the structure of the first conductive portion is a symmetric structure with respect to the ground portion.

14. The antenna module as claimed in claim 9, wherein the first extension portion and the second extension portion are spaced from each other, and third extension portion and the fourth extension portion are spaced from each other.

15. The antenna module as claimed in claim 14, wherein the dual-band antenna further comprises a first capacitor element and a second capacitor element, the first extension is connected with the second extension portion by the first capacitor element, and the third extension is connected with the fourth extension by the second capacitor element.

16. The antenna module as claimed in claim 14, wherein the second conductive portion further comprises a fifth extension portion, the fifth extension portion extends from the first extension portion toward the ground portion, the third conductive portion further comprises a sixth extension, and the fifth extension portion extends from the third extension portion toward the ground portion.

* * * * *